US005246266A

United States Patent [19]

Ostergaard

[11] Patent Number: 5,246,266

[45] Date of Patent: Sep. 21, 1993

[54] CHAIR

[75] Inventor: Steen Ostergaard, Flensburg, Fed. Rep. of Germany

[73] Assignee: Chairworks Taiwan Limited, China

[21] Appl. No.: 584,159

[22] Filed: Sep. 18, 1990

[51] Int. Cl.[5] ..... A47C 1/02

[52] U.S. Cl. ..... 297/84; 297/317; 297/342; 297/320

[58] Field of Search ..... 297/83, 84, 317, 318, 297/320, 321, 322, 342, 436, 433, 355, 438, 328, 342, 317

[56] References Cited

U.S. PATENT DOCUMENTS

| | | | |
|---|---|---|---|
| 2,954,072 | 9/1960 | Fossati | 297/84 |
| 2,986,201 | 5/1961 | McCorton | 297/438 |
| 3,989,297 | 11/1976 | Kerstholt | 297/355 |
| 4,635,999 | 1/1987 | Simpson | 297/328 |

FOREIGN PATENT DOCUMENTS

| | | | |
|---|---|---|---|
| 479408 | 12/1951 | Canada | 297/84 |
| 501396 | 4/1954 | Canada | 297/84 |
| 8606596 | 11/1986 | PCT Int'l Appl. | 297/83 |
| 506854 | 6/1939 | United Kingdom | 297/84 |
| 2158350 | 11/1985 | United Kingdom | 297/84 |

*Primary Examiner*—Kenneth J. Dorner
*Assistant Examiner*—Cassandra Hope Davis
*Attorney, Agent, or Firm*—Bierman and Muserlian

[57] ABSTRACT

Chair comprising an underframe, a back being pivotally connected to the underframe, a seat being pivotally connected to the back, the seat at its front edge also being pivotally connected to a foot rest which by a guide is so connected to the underframe that the angle which the foot rest forms with the seat varies with displacement of the seat. The control consist of sliding device being pivotally connected to the underframe and spring which impart a force impacting in the longitudinal direction to the sliding device in dependence on the position of the chair.

9 Claims, 5 Drawing Sheets

CHAIR

Figure 1:
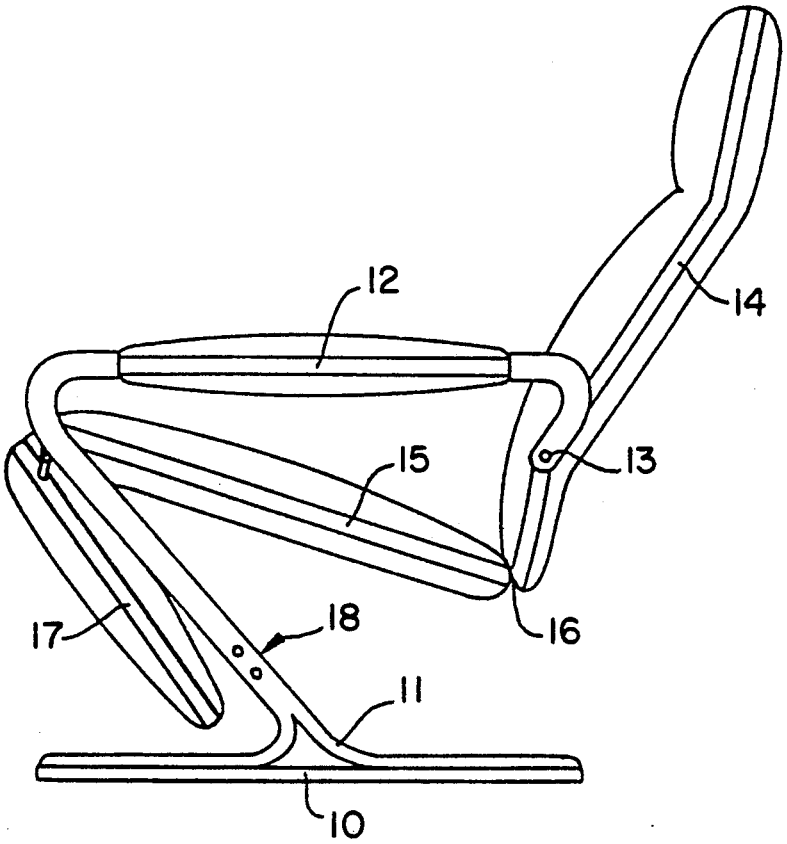

The present invention relates to a chair having an underframe, a back being pivotally connected thereto, a seat being pivotally connected to the back, the seat at its front edge also being pivotally connected to a foot rest which by means of guide means is so connected to the underframe that the angle which the foot rest forms with the seat varies with displacement of the seat.

A variety of chairs is known where the back rest and foot rest may be positioned in such away that a person from a sitting position may shift to a substantially horizontal position of rest. The most simple design of these chairs comprises a parallelogram which connects the foot rest and the back of the chair where the seat is also often part of the parallelogram. As this construction does not readily offer the possibility of positioning the chair in an arbitrary balanced position it is necessary to provide the chair with special locking means, so that a selected position of the parallelogram can be maintained. This is disadvantageous as a person must then lock the chair before settling himself. If the chair is only locked at one side there is also the risk that the chair frame gets distorted.

Danish Patent Application No. DK 2036/85 describes a chair as described in the introduction having a guide rod secured to the foot rest, the said rod being displaceable in a sliding sleeve being pivotally secured to the underframe. By this kind of chair it is possible to adjust the position of the foot rest by displacement of the seat, and this position may be maintained without use of special locking means. However, this chair has one significant drawback, as the construction with guide rod and sliding sleeve means that the length of the lever which transfers the displacement of the seat into movement of the foot rest varies from maximum length in the swung out position of the foot rest to minimum length in swung in position. Consequently, the foot rest in the swung in position will just be vertical as there is insufficient moment to ensure that it is swung under the chair and remains there. This is particularly disadvantageous as a person raising himself from the chair is thus forced to place his feet far in front of his centro of gravity and is consequently barred from using his legs in the usual way but has to raise himself only by means of his arms.

It is the object of the present invention to devise a chair of the kind described which makes it possible to retain the various chair parts in a stable, mutual balance in an arbitrary desired position, and which at the same time in the swung in position of the chair makes it possible to pass the foot rest in under the chair seat.

The object is obtained in that the chair comprises guide means in the form of sliding means being pivotally secured to the underframe, and means which transmit a force acting in the longitudinal direction to the sliding means in dependence of the position of the chair. By providing the guide means with sliding means known per se and compensating for the inadequate performance of the lever forming part thereof in the swung in position by a mechanism which via the sliding means transmits a force acting in the longitudinal direction thereof to the foot rest, the foot rest will in the swung in position be swung under the chair, thus enabling the user subsequently to raise himself without difficulty.

The invention further relates to a mechanism which is capable of imparting neutral equilibrium to a chair having mutually hinged parts so that the parts of the chair can be placed in an arbitrary position and maintained in this position without need for separate locking mechanisms.

The guide means may advantageously comprise telescopic sliding means where the guide rod being secured, preferably welded onto the foot rest together with a link being pivotally connected to the foot rest form the said sliding means in that the guide rod and the pivotable link comprise two tubes at least one of which being hollow and adapted to receive the other so that the latter in all essentials is capable of sliding freely therein. The force impact is preferably generated as a result of a loose coil spring being positioned between the smallest tube and an abutment in the hollow tube. By also making the inner tube hollow and providing it with an inner abutment the spring is free to move between the abutments in the two tubes and impart a force impact on the sliding means in the longitudinal direction when the spring is compressed.

Alternatively, the guide means may be formed in such a way that the guide rod being secured to the foot rest may slide in a sliding sleeve being pivotally secured to the underframe, so that the force impact is generated by a spring being positioned on the outer side of the guide rod and being compressible between the sliding sleeve and a shoulder provided on the guide rod.

It is obvious that force impacts of the above mentioned kind may also be generated by suitable constructions involving hydraulics and pneumatics.

Figure 2:
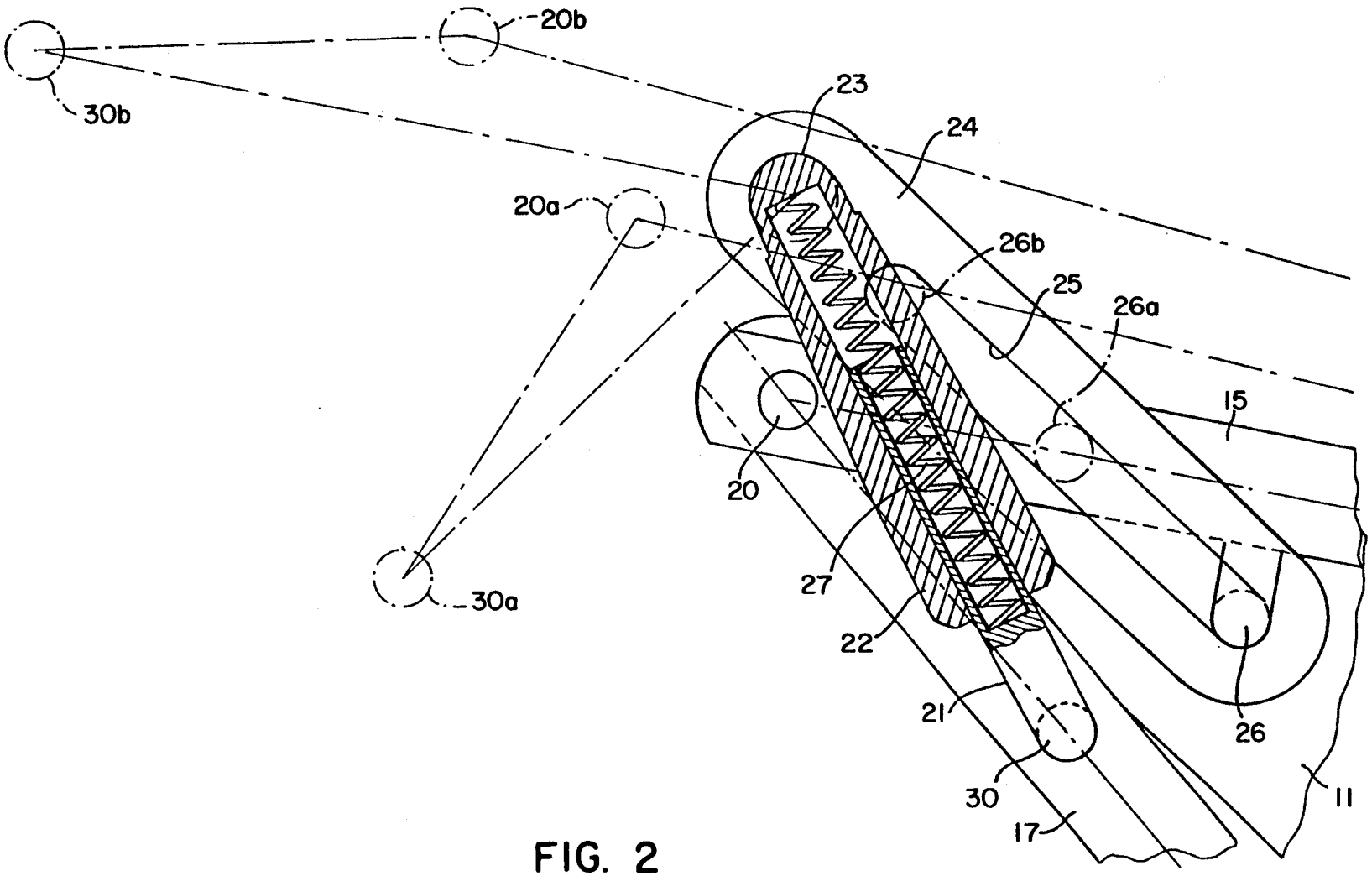
Figure 3:
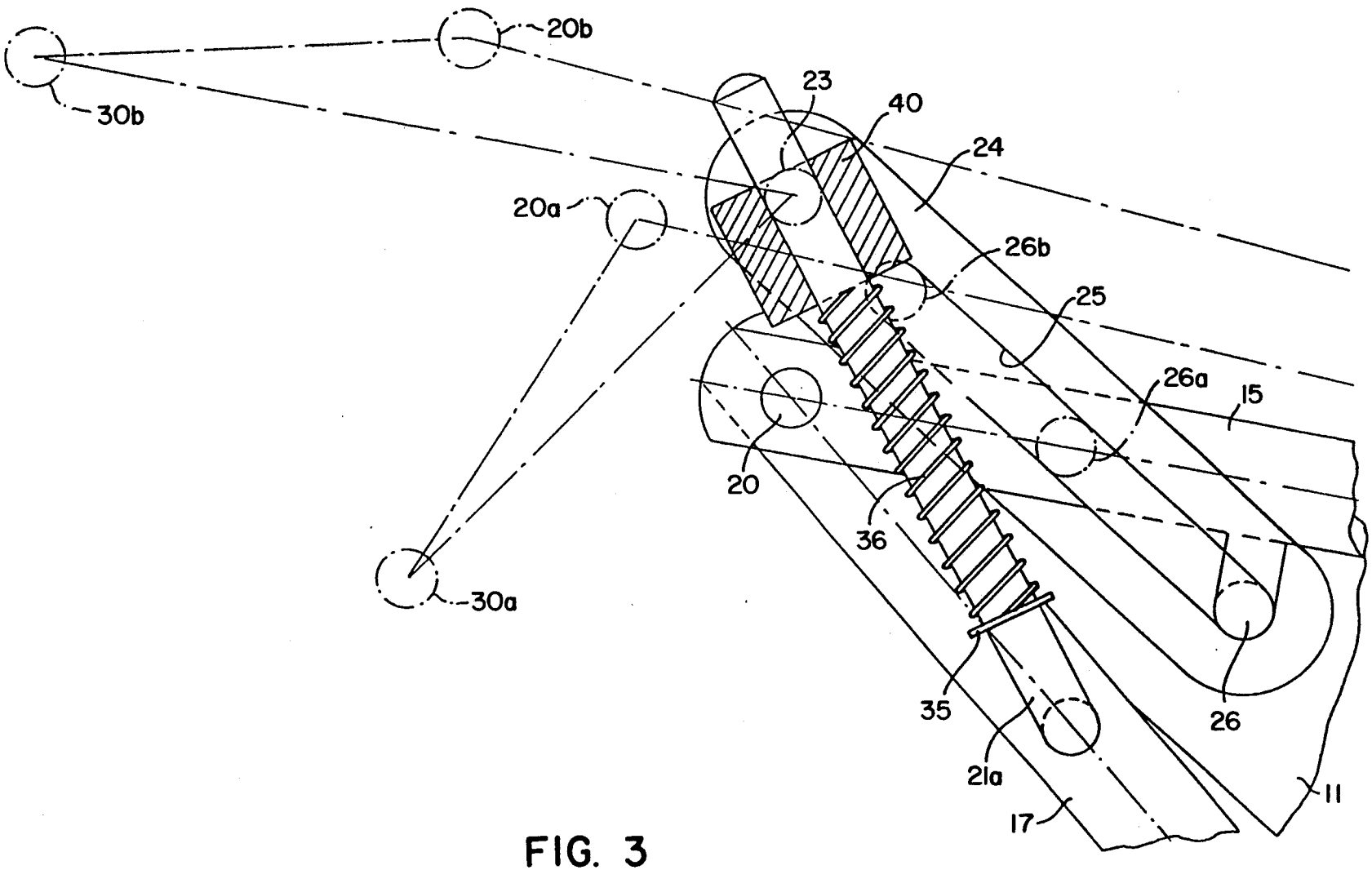
Figure 4:
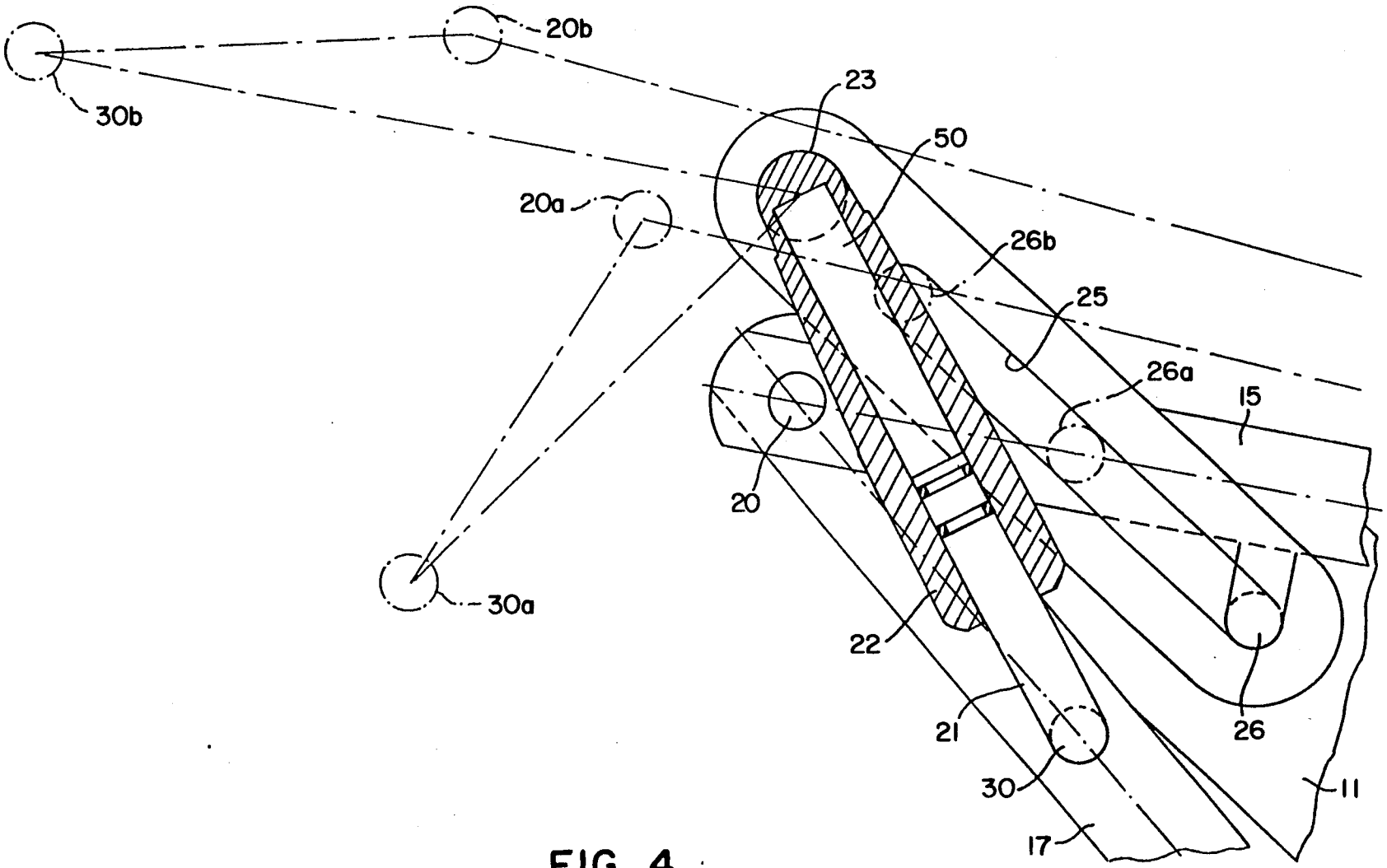
Figure 5:
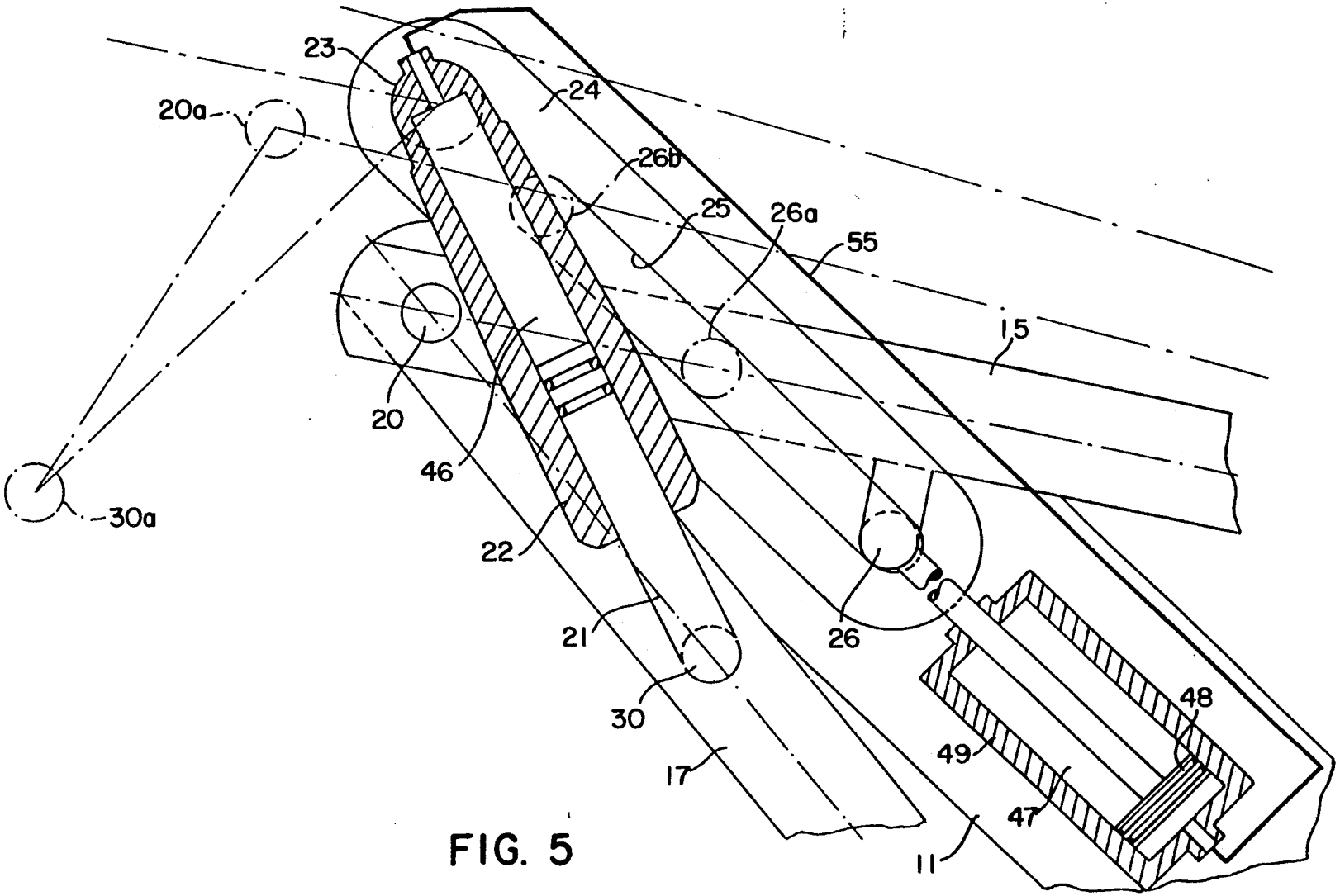

In the following the invention is described in more detail by way of preferred embodiments, reference being made to the drawing in which FIG. 1 is a side view of a chair of the kind in question and comprising a preferred embodiment of a guide mechanism according to the invention, FIG. 2 is an enlarged scale cross-section of the guide mechanism of the chair shown in FIG. 1, FIG. 3 is an alternative embodiment of the guide means according to the invention shown in FIG. 2, and FIG. 4 and 5 are corresponding alternatives for obtaining the desired effect of the chair according to the invention.

FIG. 1 shows a chair according to the invention comprising an underframe consisting of a base 10 in the form of two parallel foot pieces, two legs 11 secured thereto and two upholstered arm rests 12, the frame of which serves to secure the movable parts of the chair. For reasons of stability a cross bar 18 is provided between the chair legs 11. The movable parts of the chair are upholstered and consist of a back frame 14, a seat frame 15 and a foot rest 17. The back frame 14 is at both sides pivotally connected to the rear part of the frame of the arm rest 12 by means of a pivot 13. The back frame 14 and the seat frame 15 are pivotally interconnected by a hinge 16 and the seat frame 15 is at its front edge also pivotally connected to the foot rest 17 via a hinge 20 shown in FIG. 2.

The chair is so constructed that the parts which control the position of the movable parts of the chair are not readily distinguishable, and FIG. 2 shows a sectional view of these parts, FIG. 1 thus only showing the construction of the chair in question. As already mentioned the foot rest 17 is pivotally connected to the seat frame 15 by a hinge 20. Additionally, the seat frame 15 is at either side displaceably connected to the underframe by sliding pins 26 being in engagement with a sliding track 25 provided in each leg 11. A hole for receiving a pin 23 has been provided in continuation of the sliding tracks 25, whereby the guide means are hidden for reasons of aesthetics and safety. The sliding tracks 25 and the said holes for the pins 23 may advantageously be formed as one body 24 of injection moulded plastics which is secured e.g. by glueing to the chair legs 11.

At either side of the frame 17 of the foot rest there is provided a guide rod 21 projecting therefrom, the said rod preferably being welded onto the frame 17 proper. The guide rod 21 is preferably a folded tube section the two parts of which form a right angle and the shortest part of which is secured onto the frame 17 so as to project therefrom under formation of a right angle. The longest part forms an acute angle, approx. 15° with the upper part of the frame 17. The longest part of the guide rod 21 is hollow inside and provided with an abutment and thus being adapted for receiving the one end of a spring 27, the latter being made preferably of metal. The outer diameter of the guide rod 21 is so adapted that together with the spring 27 it can be received in a sleeve 22 being connected to the pivot 23 under formation of telescopic means. The sleeve 22 and the pivot 23 are preferably an integral unit.

When the telescopic means are fully extended the spring 27 is free to move in the cavity formed by the guide rod 21 and the sleeve 22, whereas when the telescope is compressed there is a point at which the spring gets loaded, whereafter the spring will influence the telescopic means by a force which is substantially proportional to the distance from the point at which the load on the spring 27 is initiated. The swung in position of the chair is shown in FIG. I, in which the back is erect and the foot rest positioned under the chair. When a person sits down in the chair and pushes the back rest backwards it will turn about the pivot 13 and drive the seat 15 forward whereby the sliding pin 26 will slide obliquely upwards in the sliding track 25 causing the hinge 20 between the seat 15 and the foot rest 17 to follow a substantially straight path which essentially follows the sliding track 25. This movement of the foot rest however does not follow a straight line as the hinge 16 between the back 14 and the seat 15 describes a circular movement. In that the hinge at the seat and the foot rest 17 as a result of the displacement of the seat 15 are made to perform a substantially linear movement the foot rest 17 swings out and moves towards the horizontal position. This is due to the fact that the foot rest moves about two pivoting points, the pivot 23 and the hinge 20, and that an attachment point 30 for the guide rod 21 to the foot rest 17 together with these points form a triangle where the angle between the guide rod and the foot rest and the length between the attachment point 30 and the hinge 20 are constant, while the length of the guide rod or the telescopic arm 21, 22 is variable. By displacing the seat 15 and consequently the hinge 20 the force transferring arm between the hinge 20 and the pivot 23 will move the foot rest 17 to as swung out position, e.g. as shown schematically, where the hinge 20 has been brought into a position 20*a*, while the attachment point has been brought into a position 21*a*. By further displacement of the seat 15 the foot rest can be brought into a substantially horizontal position where the hinge 20 assumes the position indicated by 20*b* and the attachment point 21 has been brought into position 21*b*. Here the neutral equilibrium is significant as a movement of the foot rest in its horizontal position substantially corresponds to a parallel displacement of the seat and the foot rest through the telescopic arm. It should be noted that the length of the telescopic arm varies so as to have in the horizontal position of the foot rest 17 a length ensuring that the spring 27 is at rest and consequently does not influence the position of the chair. By swinging down the foot rest 17 the telescopic arm 21, 22 as a consequence of the displacement of the pivot points 20, 23 be made shorter and consequently impart a force acting in the horizontal direction to the telescopic arm 21, 22.

Thus by taking advantage of the fact that the length of the telescopic arm 21, 22 varies during the swinging movement of the foot rest 17 and adapting the path which the hinge 20 describes during displacement of the seat 15 to the length of the telescopic arm 21, 22, the distance between the hinge 20 and the attachment point 30, and the angle with which the telescopic arm is obliquely positioned relative to the foot rest 17, it is possible to ensure that the telescopic arm 21, 22 is shortest in a position half way between the shown swung in position and the marked intermediary position, whereby the length of the arm is increased and the tension of the spring lowered when swinging in or out from this point. Consequently, the spring 27 shows a tension characteristic having its local minimum in the swung in position and the aggregate force acting on the foot rest 17 will in this area be dominated by the spring force and the force of gravity, wherefore the spring force may be dimensioned to surpass the force of gravity acting on the foot rest 17 and pass the foot rest 17 under the chair.

FIG. 3 shows an alternative embodiment of the control means in which the guide rod 21 has been replaced by a new guide rod 21*a* which like the guide rod already mentioned is secured to the foot rest 17, but provided with a collar 35, and slides in a sliding sleeve 40 being movably secured to the underframe. A spring 36 is positioned between the collar 35 and the sliding sleeve 40 to generate the necessary force in the longitudinal direction of the control rod.

FIG. 4 schematically shows how the spring 27 shown in FIG. 2 in the telescopic arm 21, 22 can be replaced by a gas cylinder 50 filled with compressed air, where the movable link then acts as a cylinder whereas the guide rod 21 acts as a piston. Hereby substantially the same effect is obtained, but the cylinder/piston configuration is active in the entire length displacement area of the telescopic arm.

Alternatively, the piston/cylinder configuration may be replaced by the hydraulic system shown in FIG. 5, where the control rod 21 still acts as piston in a cylinder 22 having a cavity 46. The cylinder 22 then has a passage 55 providing contact to another piston/cylinder configuration where a cylinder 49 comprises a cavity 47 the size of which is controlled by a piston 48 which e.g. is connected to the previously mentioned sliding pin 26 in the sliding track 25. Thereby the position of the seat will determine the pressure which the cavity 46 exerts on the guide rod 21.

I claim:

1. A mechanism for imparting a neutral equilibrium to a chair having an underframe, a back being pivotally connected to the underframe, a seat connected to the underframe and pivotally connected to the back, said seat at its front edge further being pivotally connected to a foot rest, the mechanism comprising a guide means connected to the underframe and connected to the footrest so that an angle which the foot rest forms with the seat varies by displacement of the seat thereof, characterized in that the guide means consists of a sliding means pivotally attached to the underframe and means to impart a force impact acting in a longitudinal direction to the sliding means depending on the position of the chair.

2. A mechanism according to claim 1 characterized in that the guide means consist of a first and second tube section telescoping the first tube is pivotally connected to the underframe while the second tube is hollow and secured to the foot rest and adapted to displaceably receive the first tube and a compressible spring positioned within the hollow second tube and between the first and second tube.

3. A chair according to claim 1, characterized in that the guide means consist of a guide rod attached to the foot rest, the said rod being displaceably connected to a sliding sleeve being pivotally secured to the underframe, and that the force impact acting in the longitudinal direction is generated between a collar provided on the guidel rod and a spring provided on the sliding sleeve.

4. A mechanism according to claim 1, characterized in that the guide means consist of two interacting tube sections which together form a telescopic arm, one end of which is pivotally connected to the underframe and the other end of which is secured to the foot rest, and that the force impact acting in the longitudinal direction of the telescopic arm is generated by compressing a gas cylinder.

5. A chair comprising an underframe; a back pivotally connected to the underframe; a seat attached to the underframe and pivotally connected to the back;

said seat at its front edge also being pivotally connected to a foot rest which by means of guide means connected to the underframe is connected to the underframe so that an angle which the foot rest forms with the seat varies by displacement of said seat;

said guide means being extractable in a longitudinal direction to a sliding means, said longitudinal direction being in a fixed relationship with the foot rest;

The sliding means pivotally attached to the underframe; and means which imparts a force impact acting in the longitudinal direction to the sliding means in dependence on a position of the chair.

6. A chair according to claim 5, characterized in that the guide means consist of a first tube sections and second telescoping the first tube is pivotally connected to the underframe while the second is hollow and secured to the foot rest and adapted to displaceably receive the first tube and a compressible spring positioned within the hollow second tube and between the first and second tube.

7. A chair according to claim 5, characterized in that the guide means consist of a guide rod attached to the foot rest, the said rod being displaceably connected to a sliding sleeve being pivotally secured to the underframe, and that the force impact acting in the longitudinal direction is generated between a collar provided on the guide rod and a spring provided on the sliding sleeve.

8. A chair according to claim 5, characterized in that the guide means consist of two interacting tube sections which together form a telescopic arm, one end of which is pivotally connected to the underframe and the other end of which is secured to the foot rest, and that the force impact acting in the longitudinal direction of the telescopic arm is generated by compressing a fluid in dependence of the position of the chair.

9. A chair according to claim 8, characterized in that the force impact is generated by a gas cylinder.

* * * * *